US005169016A

United States Patent [19]

Hinz, Jr.

[11] Patent Number: 5,169,016

[45] Date of Patent: Dec. 8, 1992

[54] METHOD AND APPARATUS FOR SELECTIVELY SEALING AND POURING LIQUID FROM A CONTAINER

[76] Inventor: Gunter Hinz, Jr., 23 Spring Street, Apartment 1202, Hamilton, Ontario, Canada, L8N 2P1

[21] Appl. No.: 839,307

[22] Filed: Feb. 20, 1992

[51] Int. Cl.[5] ..... B65D 51/18

[52] U.S. Cl. ..... 220/254; 220/203; 220/715; 222/484; 222/506

[58] Field of Search ..... 220/203, 254, 262, 711, 220/713, 714, 715; 222/484, 506

[56] References Cited

U.S. PATENT DOCUMENTS

| | | | |
|---|---|---|---|
| 3,727,808 | 4/1973 | Fitzgerald | 220/715 X |
| 4,099,642 | 7/1978 | Nergard | 220/715 |
| 4,946,062 | 8/1990 | Coy | 220/714 |

*Primary Examiner*—Stephen P. Garbe
*Assistant Examiner*—Nova Stucker

[57] ABSTRACT

The present invention comprises a method and apparatus for selectively sealing and pouring a liquid from a container. The device includes a hollow vessel 11 having a sealingly attached lid 12. Lid 12 includes communicating deformable pout spouts **16,16*a* therethrough and an actuating mechanism comprising an actuator member 15, actuator button 14, a transverse actuator member 20 and appended pinch clamps 19 and 19*a* which, when the actuating mechanism is urged into the null or unactivated position clamps the deformable pour spouts thereby preventing liquid from escaping from the vessel. Conversely, in the actuated position, transverse actuator member 20 and pinch bars 19 and 19*a* are released and the flexible pour spouts 16 and 16*a* return to the undeformed position. The invention further includes a poppet valve 23** interposed through a pressure release passageway which permits the escape of gaseous pressure buildup within the vessel automatically while being seated and sealed upon the sensing of a specified level of liquid within the vessel. Accordingly, gaseous buildup of a significant pressure is freely and automatically permitted to escape while the device is effectively sealed upon tipping or inadvertent upending of the vessel.

17 Claims, 4 Drawing Sheets

Fig. 3.
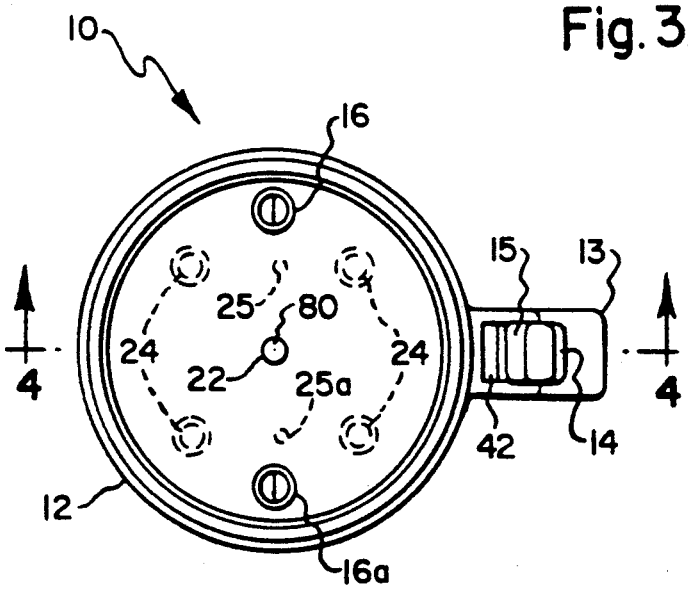
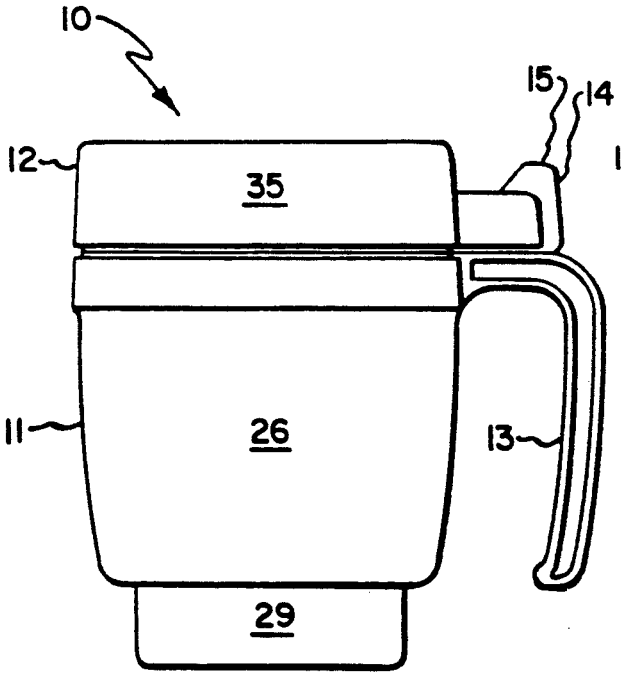
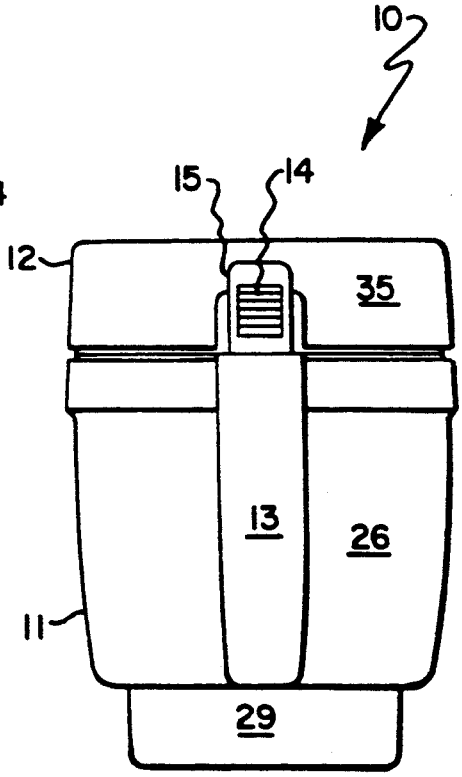
Fig. 1.
Fig. 2.

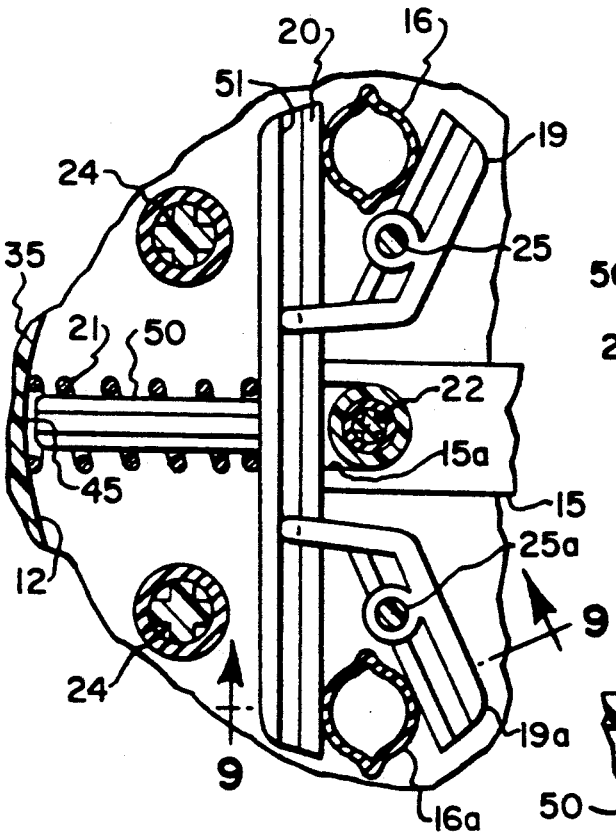
Fig.7.
Fig.8.
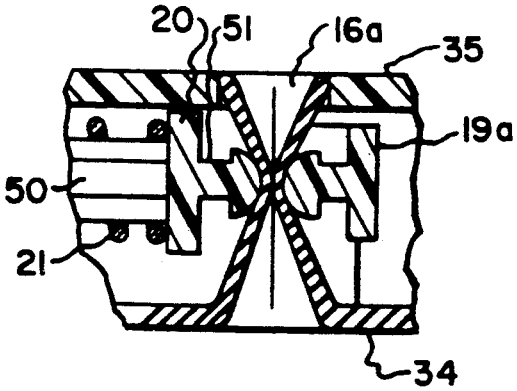
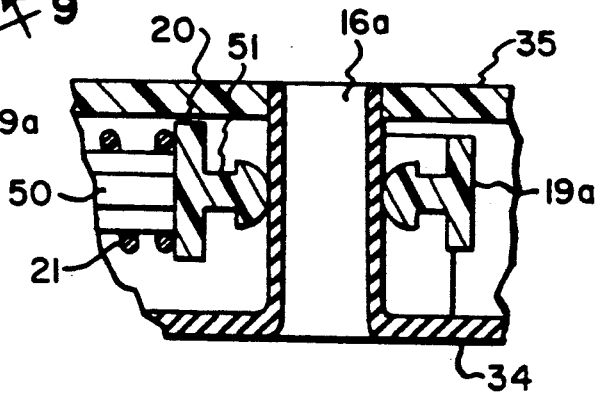
Fig.9.
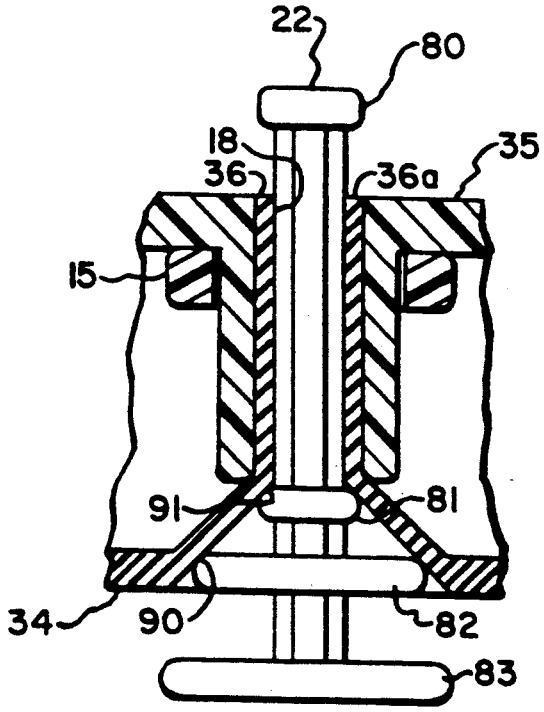
Fig.10.

METHOD AND APPARATUS FOR SELECTIVELY SEALING AND POURING LIQUID FROM A CONTAINER

TECHNICAL FIELD

The present invention relates generally to the field of sealing lids for containers and specifically, to a device for selectively providing convenient pouring of liquids held in small containers such as cups, glasses and mugs, while insuring against inadvertent or unintended spillage.

BACKGROUND OF THE INVENTION

It is often desirable to tightly seal various small liquid-containing vessels to allow handling without inadvertent spilling. This is particularly desirable with soft drink containers, cups or other beverage vessels used to contain drinks or other potable liquids. Similarly, the concept is also useful when applied to paints, chemicals or closely controlled liquids where spillage may create a safety, environmental or aesthetic problem.

It is particularly important to provide a tight seal of the liquid when the vessel is inadvertently moved, tipped or placed at rest, while flexibly permitting access to the liquid for pouring or refilling. It is also important to insure that any gaseous accumulation within the sealed vessel may readily escape without disturbing the contained liquid independent of whether the vessel is upright, upset or substantially tipped.

The known prior art attempts to provide a solution to this problem have met with little practical success. For example, various vessels have been designed with an extremely wide base and narrow neck, thereby lowering the center of gravity and providing a "tip-less" feature. Nonetheless, even if not "tipped" or upset, liquid is capable of escaping through the open top of these types of vessels.

Attempts have also been made in the prior art to provide for mechanical-type lids having various mechanisms for opening and closing a pour spout in an effort to seal the underlying vessel. See, for example U.S. Pat. Nos. 4,183,443; 4,190,173; 4,276,992 and 4,303,173. These devices, however, have proven to be mechanically ineffective, unreliable and cumbersome and fail to address the problem of gaseous pressure buildup within the vessel attendant to tight sealing. Accordingly, these devices would not be amenable for use with liquids or other viscous materials that may present gases depending upon environmental conditions. Too, these prior art devices generally fail to include optimal conditions for pouring by the inclusion of a pressure equalization method, e.g., companion orifices for balancing inner and outer pressures. Thus, the prior art, although providing a sealed container, fails to address the more practical aspects presented by the problem of sealing and pouring.

Accordingly, the present invention contemplates a mechanically uncomplicated sealing mechanism adaptable for use with typical hand-held containers for tightly sealing and "spill-proofing" the contained liquid, while permitting easy access for pouring and refilling and an effective escape mechanism for potentially disruptive gaseous pressure buildup within the vessel. Thus, the present invention effectively and completely solves the problems prevalent in the prior art in an efficient, straightforward and mechanically practical manner.

DISCLOSURE OF THE INVENTION

With parenthetical reference to the drawing figures herein, the present invention generally comprises a hollow vessel or container (e.g., 11) typically cylindrical in shape, having a separate and tightly sealingly engaged lid (e.g., 12) directly engaged to the open top of the container or vessel; a handle (e.g., 13) conveniently mounted to the vessel for easy gripping; an actuator (e.g., 15) and actuator button (e.g., 14) operatively arranged adjacent to the handle so the actuator button and actuator may be effectively operated with one of the fingers of the gripping hand while maintaining a tight and solid grip on the handle; a pair of deformable pour spouts (e.g., 16,16*a*) forming two communicating passageways between the inside of the vessel or container and the outside of the lid; a pressure release opening (e.g., 18) forming a separate communicating passageway between the inside of the vessel and the outside of the lid; a pair of pinch bars (e.g., 19,19*a*) interposed within the lid and adapted to selectively pinch the pour spouts closed and permit the pour spouts to open in conjunction with an actuator bar (e.g., 20) controlled by the actuator and actuator button. The actuator, actuator bar and pinch bars are urged into the null, closed position thereby precluding ingress and egress of liquid through the pour spouts by an actuating spring (e.g., 21) encasing one end of the actuator. A poppet valve (e.g., 22) is positioned through the pressure release opening thereby permitting gas to escape as the valve is seated and unseated as a result of gaseous pressure while a series of annular valve guide disks (e.g., 81, 82, 83) effectively seal the pressure release opening by seating when the liquid level in the vessel rises to a preselected point.

Accordingly, in the null position, the actuator spring forces the pinch bars and actuator bar to "clamp shut" the flexible pour spouts thereby sealing ingress and egress of liquid therethrough. Similarly, the poppet valve interposed through the pressure release opening, while permitting gaseous pressure to selectively escape therethrough will, upon the sensing of a liquid level against the annular guide disks, effectively seal the pressure opening. Similarly, actuation of the mechanism by pushing the actuator button effectively relieves the pinching force on the pour spouts thereby permitting free ingress and egress through the two open apertures. The pair of open pour spouts further serve to equalize pressure between the inside and outside of the vessel and facilitate pouring. If, during operation, however, the container or vessel is dropped, the actuator spring automatically and simultaneously urges the pinch bars and actuator bar to clamp shut (i.e., deform) the pour spout openings. Contemporaneously, provided the liquid level rises during the course of a spill or dropping of the vessel, the poppet valve annular guide disks will seat the valve from below to effectively seal the pressure release opening.

Accordingly, the present invention provides an efficient and effective method and apparatus for selectively sealing and unsealing for pouring or refilling a liquid-containing vessel or container while insuring against inadvertent spillage from tipping or dropping. Moreover, the present invention insures the safe and efficient removal of gaseous pressure buildup within the vessel attendant to normal and tight sealing, while providing a means for sealing the pressure outlet to avoid inadvertent spilling of liquid therethrough.

Thus, the object of the present invention is to provide a safe, efficient and mechanically uncomplicated method and apparatus for effectively sealing a container.

Still another object of the invention is to provide a means for effectively sealing a container, while insuring egress of gaseous pressure buildup within the vessel, without the potential escape of liquid attendant to spilling.

Still another object of the invention is to provide a method and apparatus for selectively sealing a liquid-containing vessel that is adaptable to beverages and potable liquids, as well as other liquids such as paints, chemicals or the like.

These and other object and advantages of the invention are apparent from the foregoing specification and from the following drawings, written description and claims.

DESCRIPTION OF THE DRAWING FIGURES

FIG. 1 is a side elevation of the invention.

FIG. 2 is an end elevation of the invention showing the handle, actuator member and actuator button.

FIG. 3 is a top plan view of the lid portion of the invention showing the deformable pour spouts, pressure release opening and actuator and handle.

FIG. 7 is a fragmented longitudinal sectional view of the lid portion showing the actuator in the engaged or open position.

FIG. 8 is a transverse sectional view taken along 8—8 of FIG. 5 showing the pour spout, actuator bar and pinch bars in the null or closed position.

FIG. 9 is a transverse sectional view taken along 9—9 of FIG. 7 showing the actuator bar, pinch bar and pour spout in the open or engaged position.

FIG. 10 is a transverse sectional view taken along 10—10 of FIG. 9 showing the poppet valve in the "seated" position thereby closing the pressure release passageway.

MODE(S) OF CARRYING OUT THE INVENTION

Figure 5:
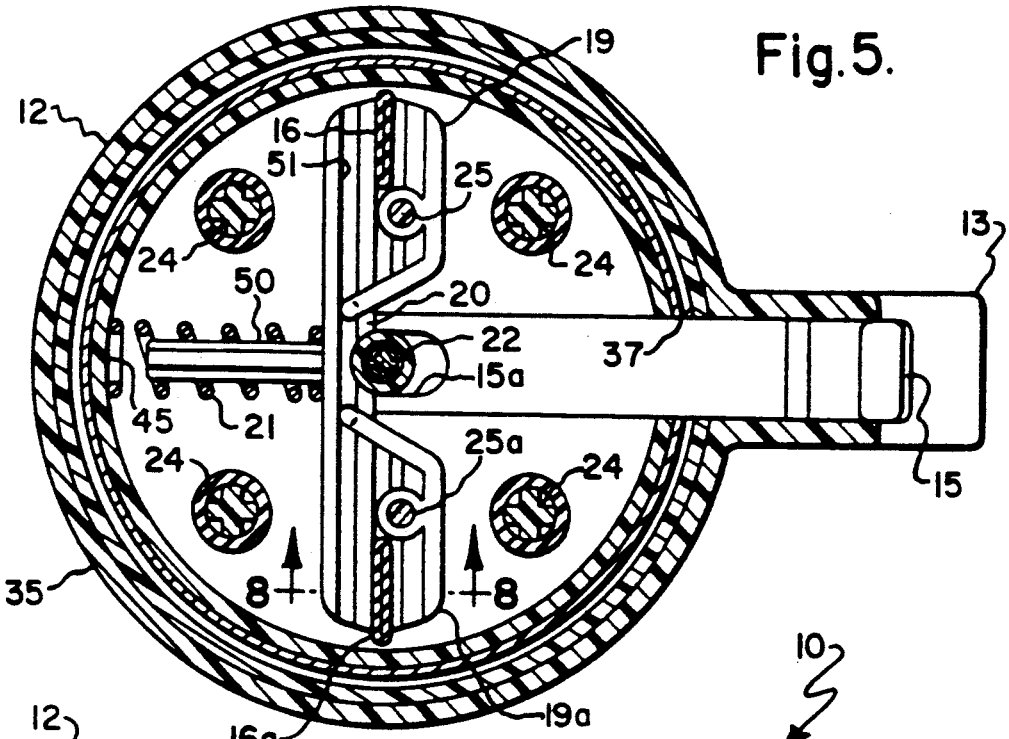
FIG. 5 is a longitudinal sectional view of the lid portion of the invention taken along 5—5 of FIG. 4 showing the actuator mechanism in operation in the null or closed position.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Turning first to FIGS. 1 and 2, the present invention, 10, generally comprises a hollow vessel or container, 11, having a substantially cylindrical, hollow shape and an open top, 17; an appended integrally connected handle, 13, for easy gripping; and a sealed lid portion, 12, tightly engaging and sealing the open top 17 of the vessel. Lid portion 12 further includes, positioned above handle 13, a slidably mounted actuator member, 15, interposed through the lid portion and across the diameter of the vessel and lid and an actuator push button, 14, positioned at the outside end of the actuator member for easy depression by an operator's thumb while maintaining a firm grip on handle 13.

For ease of handling and manufacture, the components of the present invention are typically extruded or injection molded plastic or other similar material easily formed and having liquid-containing properties, as well as desirable insulating properties, if possible.

Turning now to FIG. 3, the lid, 12, is shown in top plan view and includes flexible, deformable pour spouts, 16,16*a* forming a pair of communicating passageways from the inside of the vessel, 17, to the outside of the top lid. The pour spouts are generally formed of deformable rubber-like or plastic material capable of being "pinched" closed, yet returning to an "un-pinched" shape upon release of any pinching force. The plan view of the lid portion also discloses pressure release opening 18, a non-deformable communicating passageway between the inside hollow of the vessel and the outside of the lid positioned approximately at the center point of the lid diameter. Pivot pins, 25,25*a* are positioned adjacent to each of the pour spouts between the centered pressure release opening and, as is discussed in detail below, are an integral part of the operation of the actuator mechanism and pinch bars. Also shown in FIG. 3 are mounting pins 24 arranged at equidistant points around the circumference of the lid for effectively joining together the various components of the lid portion.

Figure 4:
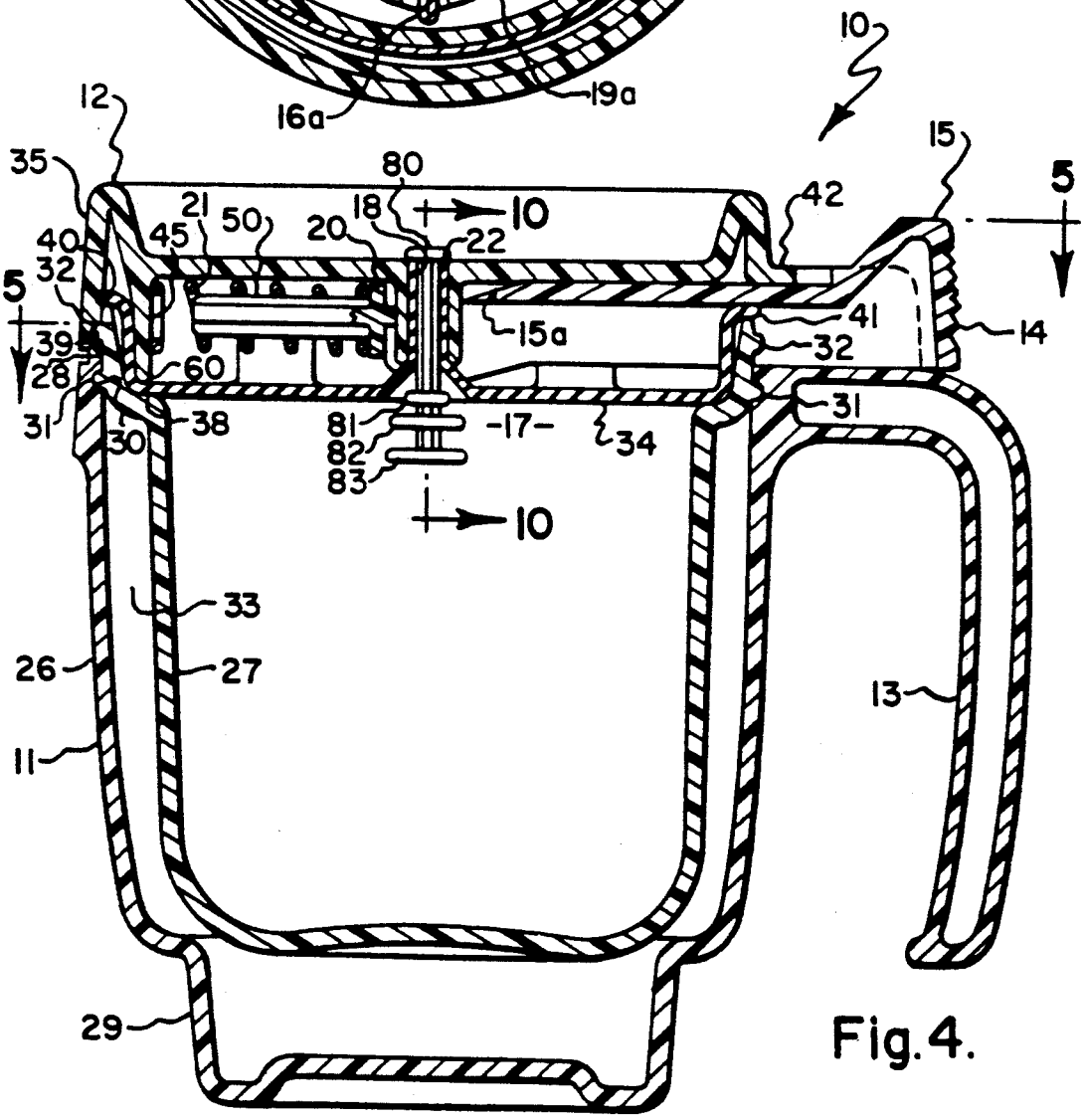
FIG. 4 is a transverse sectional view of the invention taken along 4—4 of FIG. 3 showing an assembled view of the lid and vessel, together with the actuator mechanism.

Specifically turning to FIGS. 4 and 5, the lid components and container are shown in sectional detail. Turning first to FIG. 4, vessel 11 is shown to comprise two specially configured substantially U-shaped, thin-walled, cup-like members, one interposed within the other. In particular, inner U-shaped body 27, the smaller of the two, is interposed within outer U-shaped body 26 and together, bodies 26 and 27 form the hollow, open topped vessel 11. Vessel bodies 26 and 27, joined one within the other, are sealingly and snugly connected by way of a notch and tab assembly 28 along the circumferences thereof. In particular, outer body 26 includes, at its bottom end, a narrower annular base 29 and along its top rim a grooved notch 30 adapted to receive a corresponding tab 31 along the top circumferential surface of inner body 27. Inner body 27 further includes a second notch, 32, above notch 31, for attachment to the lid top portion, described below. Accordingly, the tab and notch assembly 28 results in a tight and efficient seal between the walls forming the vessel 11. Further, vessel bodies 26 and 27, as a result of their sealing fit and configuration, form therebetween a hollow air space 33 which necessarily adds to the insulating properties of the vessel.

Figure 6:
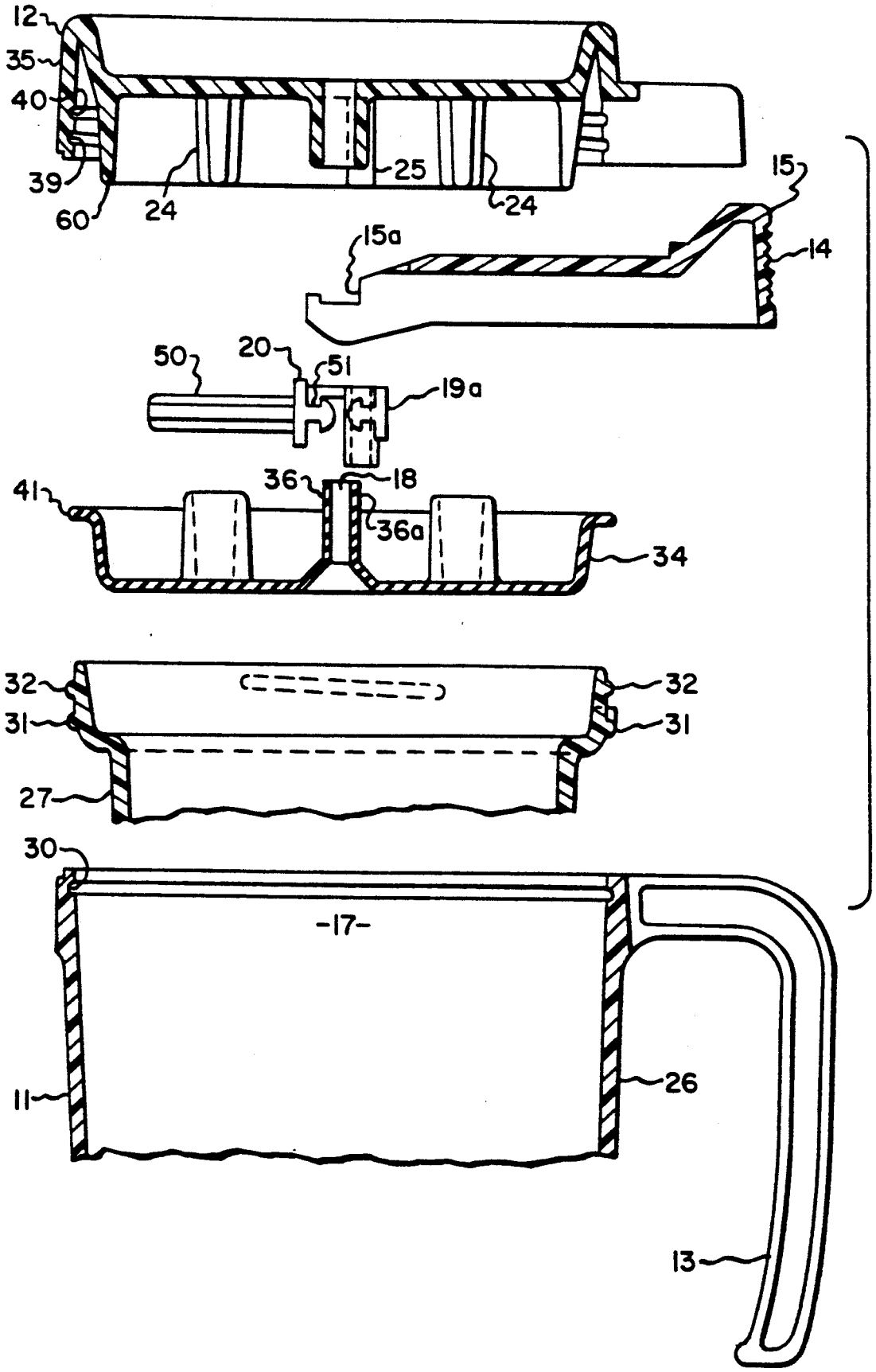
FIG. 6 is a fragmented transverse sectional assembly view of the lid portions and vessel, together with the actuator.

Turning now to FIGS. 5 and 6, lid portion 12, together with the actuating mechanism of the invention, are illustrated. In particular, lid portion 12 is shown to be comprised of two primary specially-configured substantially annular, dish-like structures, inner lid portion, 34, and outer lid portion, 35. Specifically, inner lid portion 34 is configured to fit snugly within the top portion of inner body wall 27 at its top opening in a seat-like junction, 38. Inner lid portion 34 includes, at its diametric center, pressure release passageway 18 comprised of arcuate cylinder walls 36 and 36*a*. Pressure release passageway 18, in turn, provides a communicating passageway between the inside of the vessel 11 and the space above the lid. Passageway 18 is non-deformable and is of a fixed diameter and cylindrical shape at all times during operation. As set forth below, pressure release passageway 18 is adapted to receive a poppet valve, 22, as part of the pressure release mechanism associated with the invention. As with all components of the lid, inner lid portion 34 includes, at the handle end of the invention, an opening, 37, into which the actuating member 15 may be slidably interposed across the diameter of the lid and vessel.

Outer lid portion 35 is similarly a specially-configured dish-like annular thin-walled member adapted to fit within and snugly engage inner lid portion 34 and inner body 27 of vessel 11 to form a tight sealing fit among all components of the invention resulting in a vessel impervious to leaking of the contained liquid. Specifically, outer lid portion 35 is connected to inner vessel body 27 by a tab and notch assembly. Outer lid portion 35 includes, at its bottom outside edge, a notch 39 adapted to receive therein tab 32 of inner body 27. Too, outer lid portion 35 includes a second notch 40 directly above notch 32 adapted to receive tab 41 interposed at the uppermost edge of inner lid body 34. Thereafter, the bottom edge 60 of top lid portion 35 seats itself within the inside diameter of inner lid portion 34 thereby forming a hollow between the two members as is shown in FIGS. 5 and 6. Top and bottom lid portions 34 and 35 are further joined by mounting pins through mounting pin openings 24 which are formed via complementary specially formed passageways molded as part of inner and outer lid portions 34 and 35. Accordingly, the lid portions are securely appended together and are sealably joined snugly to the vessel body 11 through the notch and tab assembly.

Similar to the vessel bodies, outer and inner lid portions 34 and 35, at the point of the handle of the device, include a space 37 into which the actuator member 15 may be slidably inserted through the diameter of the lid and vessel. Moreover, outer lid portion 35 has a specially-configured lip 42 interposed at the point where the handle and actuator enter the device through space 37 whereby the top lid portion is seated over the actuator and handle thereby preventing inadvertent disengagement of the actuator or handle during operation and, in effect, encasing the slidable actuator on all sides.

For clarity, FIG. 6 graphically illustrates, in exploded fashion, the various portions of the lid, vessel and the position of the actuator member 15 upon assembly of the device.

Adverting again to FIG. 5, the position and operation of the various openings and actuating means are illustrated in detail. In particular, mounting pins 24 are shown to be positioned at points equidistant around the circumference of lid 12 and serve to hold the lid components snugly together, as well as enclose the actuator mechanism. Most importantly, flexible pour spout openings 16 and 16*a*, shown in a closed position in FIG. 5, are interposed along the diameter of the lid and from a pair of "pinchable" communicating passageways between the inside of the vessel and the area above the lid.

The actuating mechanism is shown to include a first actuating member 15, which is an elongated solid member having a horseshoe shaped collar portion 15*a* adapted to fit around pressure release valve opening 18 formed by arcuate sections 36 and 36*a* of lid inner portion 34. Actuating member 15, has on its outside end, actuating button 14 positioned in close proximity to handle 13 for easy depression by the operator's thumb or other convenient digit. Actuator collar portion 15*a* is, at its end portion, connected to transverse actuator bar 20 at a 90° angle, together forming a combined member around pressure relief valve opening 18. In turn, connected to the back of transverse actuator bar 20, in a plane parallel to that of first actuator member 15, is second actuator member 50 which extends almost through the remaining diameter of the vessel portion to inner wall point 45. Second actuator member 50 is a generally cylindrical member and is adapted to receive therearound actuator spring 21 which, at its end portion, abuts transverse actuator bar 20 at one end and the inner edge (i.e., at point 45) of top lid portion 35 at its other end.

A pair of substantially L-shaped spring-loaded pinch bars 19 and 19*a*, are interposed at their one end within groove 51 of transverse actuator bar 20 and are positioned such that their angled leg portion fits snugly around pivot pins 25 and 25*a*.

As shown best in FIG. 5, in the null or unactuated position, actuator spring 21 guided by second actuator member 50 forces transverse actuator bar 20 outward toward the pressure release opening 18 and accordingly, the outermost edges of transverse actuator bar 20 partially deform flexible pour spouts 16 and 16*a*. Similarly, in the null position, pinch bars 19 and 19*a* fit snugly around pivot pins 25 and 25*a* such that the end portion of the pinch bars deform the remaining portion of flexible pour spouts 16 and 16*a* thereby closing or "pinching" the pour spouts snugly together so that no liquid may escape. Thus, in the null position, the flexible pour spouts are urged closed through the pinching action of the transverse actuator bar and pair of pinch bars.

As best illustrated in FIG. 7, in the actuated position; i.e., when actuator button 14 is depressed and first actuator member 15 is slided forward into the diameter of the vessel and lid such that collar portion 15*a* abuts pressure release passageway 18, transverse actuator bar 20, appended second actuator member 15*a* and spring 21 are guided inwardly away from pressure release opening 18 toward outside contact point 45. As a result, the pinching effect of transverse actuator member 20 upon flexible pour spout openings 16 and 16*a* is alleviated. Further, as actuator bar 20 is guided inwardly, pivot pins 25 and 25*a* necessarily pivot pinch bars 19 and 19*a* away from and out of contact with the other deformed portion of flexible pour spout openings 16 and 16*a* thereby allowing the flexible pour spout to return unimpeded to its open position. When, of course, actuator button 14 is released, spring 21 urges the entire actuating mechanism back to the null or closed position as shown in FIG. 5.

FIG. 8 specifically shows in cross section the actuating mechanism in the null or closed position wherein flexible pour spout opening 16a is closed by the pinching action of the transverse actuator member contact portion 20a and the contact portion of pinch bar 19a thereby sealing the pour spout. Conversely, FIG. 9 shows in cross section the release of the pinching action of the transverse actuating member and pinch bar through the depression of actuating button 14 and concomitant movement of transverse actuating member 20 and pinch bars 19 and 19a around pins 25, 25a. In FIG. 9, flexible pour spouts 16a is in its undeformed open position and liquid is free to enter or exit therethrough.

In addition to selectively controlling the ingress and egress of liquid, especially in the null, unattended closed position, the invention also contemplates automatic release of gaseous pressure from contained liquids. In particular, adverting to FIG. 10, poppet valve 22 is shown to be interposed within pressure release opening 18 formed as a cylinder by arcuate members 36 and 36a of inner lid portion 34 and strengthened by encasing of the complementary cylindrical portion of outer lid 35. In particular, poppet valve 22 is an essentially cylindrical elongated member of sufficient length to transverse the entire pressure release passageway 18 with additional length to accommodate seating and unseating of the valve during operation. The valve is topped by annular disk portion 80 which, when the valve is seated downward by gravity, will effectively seal the open area between arcuate sides 36 and 36a and the body of poppet valve 22 to both gas and liquid escape. Similarly, the bottom portion of poppet valve 22 includes a cascading group of three spaced disks of varying annular diameter, 81, 82 and 83, adapted to force the poppet valve closed from below and double-seal passageway 18 to prevent the escape of liquid. In particular, when the liquid level in the vessel rises to the level of annular disk 83, the entire poppet valve is urged upward from the force of the liquid against the annular surface of disk 83. As a result, annular disk 82, of somewhat smaller diameter, is urged against the angled walls of inner lid portion 34 forming a seal, 90. Similarly, still smaller annular disk 81 is, too, forced against a still narrower angled portion of inner lid 34 forming the bottom of pressure release passageway 18 to form yet another seal, 91. Accordingly, as long as the liquid level exerting an upward force against disk 83 is sufficient in magnitude, the poppet valve will remain seated from below and seals 90 and 91 will remain tight. In this way, any inadvertently raising of the liquid level within the container is precluded from exiting through the pressure release passageway. Accordingly, if the vessel is tipped or jarred, the poppet valve is automatically seated from below and will close if liquid is forced against disk 83. This prevents inadvertent leakage of liquid.

If, however, during normal operation, gas builds within the vessel chamber, the poppet valve will likely remain downwardly disposed and unseated. Accordingly, small amounts of gas will be permitted to escape through the unsealed passageway, upwardly, and if of sufficient pressure, will momentarily unseat top disk 80 upon escape. Thus, the poppet valve assembly is adapted to permit the escape of gases of sufficient pressure, while guarding against inadvertent leakage of liquid through the pressure release passageway if the vessel is tipped or upset.

In operation, the vessel will be filled with a liquid, e.g., a beverage, and while in the null position, the pour spouts will be closed through the pinching effect of the actuating mechanism, while the poppet valve will permit the escape of any carbonated or gaseous pressure buildup. If pouring is desired, the operator only need depress actuator button 14 which, as described above, will cause the transverse actuator bar and pinch bars to release the clamping action on the deformable pour spouts. The liquid may then be easily poured out of either pour spout with the other serving as a pressure balancing mechanism for easy pouring. If the container is left unattended and is tipped or upended for any reason, since the actuating mechanism will be in the null or clamped position, no liquid will escape through the pour spouts. Similarly, if tipping results in a sufficient volume of liquid impacting the bottom disk 83 of the poppet valve, the valve will seat from below and seals 90 and 91 will prevent any liquid from escaping through the pressure release passageway. Too, if the vessel is left unattended and contains a liquid which is vaporous, when the vapor or gas reaches a certain pressure level, it will be free to travel through the passageway and unseat the top disk 22 of the poppet valve while escaping.

Accordingly, the present invention comprises an efficient and easy method for sealing a vessel while permitting ready access for pouring and filling and insuring the ready escape of gaseous buildup without inadvertent leakage through the pressure release valve.

MODIFICATIONS OF THE INVENTION

The present invention, although disclosed in the preferred embodiment, contemplates many modifications and changes.

For example, the actuating mechanism described, although readily adaptable to a beverage container or the like, could be easily adapted to paint containers or containers for chemicals or other substances prone to inadvertent and dangerous spilling.

Moreover, although the actuating mechanism described herein is digitally activated, it is contemplated to include a different type of actuating mechanism (e.g., hydraulic) for use in larger applications of the invention.

Still another modification involves the poppet valve assembly which could easily be modified to include more or fewer seals or a plurality of pressure release valves having various characteristics of pressure sensitivity and liquid sensitivity.

These and other modifications of the invention would be clear to those having ordinary skill in the art and the present invention is not to be limited to that disclosed in the preferred embodiment.

We claim:

1. A device for selectively sealing an open-topped container having a rim edge and holding a liquid comprising:

a lid adapted to sealingly engage the edge of said container rim such that said open-top of said container is tightly sealed;

a plurality of flexible spouts interposed through said lid and adapted to provide a passageway between the inside of said container and the outside of said container, said spouts further adapted to be deformably opened and closed;

sealing means operatively connected to said spouts and adapted to selectively deform said spouts such that said spouts are pinched closed;

actuating means operatively connected to said sealing means, said actuating means having a null position and an engaged position and adapted to selectively control the deforming of said spouts, and wherein said actuating means in said null position selectively closes all of said spouts by deformation and in said engaged position opens said spouts.

whereby liquid within said container may escape through said spouts only upon selective actuation of said actuating means and whereby said spouts are pinched deformably closed otherwise.

2. The device according to claim 1 further comprising urging means operatively arranged to force said actuating means to said null position wherein said spouts remain deformed and sealed thereby.

3. The device according to claim 1 further comprising pressure release means interposed through said lid whereby gaseous pressure within said container is permitted to escape, said pressure release means being further adapted to seal itself if said contained liquid reaches a predetermined level.

4. The device according to claim 1 wherein said sealing means comprising a transverse actuating member operatively controlled by said actuating means and a plurality of pinch bars operatively controlled by said actuating means and said transverse actuating member, said transverse actuating member and said pinch bars cooperatively arranged to selectively deform to a closed position and release said spouts upon operation of said actuating means.

5. The device according to claim 1 wherein said actuating means comprises a first actuator member and a second actuator member, said first and said second actuator members operatively connected to said sealing means, said first and second actuator members being further adapted to be manually urged to said engaged position; and said actuating means further comprising a spring operatively connected to one of said first or second actuating members and adapted to urge said actuating means to said null position.

6. The device according to claim 1 wherein said spouts comprise flexible cylindrical ducts.

7. A device according to claim 2 wherein said urging means is a spring.

8. A device according to claim 3 wherein said pressure release means comprises a poppet valve interposed through said lid and adapted to be urged into position by gravity or fluid pressure.

9. A spill-proof container for containing a liquid, comprising:

a vessel having an open top portion defined by an edge and adapted to contain a liquid;

a lid configured to engage the rim edge of said vessel wherein said vessel open top portion is sealed;

a plurality of deformable spouts interposed through said lid, said spouts forming communicating passageways from the inside of said vessel to the outside of said lid;

sealing means interposed within said lid portion and adapted to selectively seal and unseal said spouts by deformation;

actuating means operatively connected to said sealing means and further adapted to selectively control the sealing and unsealing of said spouts by deformation;

urging means operatively connected to said actuating means and adapted to urge said actuating means to a null position such that said spouts are deformed closed, said urging means further adapted to position said actuating means such that said spouts are undeformed open;

whereby in the null position, said spouts are sealed and, in the engaged position, said spouts are open thereby permitting liquid to be removed from said vessel.

10. The device according to claim 9 further comprising pressure release means interposed through said lid whereby gaseous pressure within the inside of said vessel is permitted to escape through said lid, said pressure release means further adapted to seal itself if said liquid level within said vessel reaches a predetermined level.

11. The device according to claim 9 wherein said spouts comprise flexible cylindrical ducts.

12. The device according to claim 9 wherein said sealing means comprises a transverse actuating member operatively controlled by said actuating means and a plurality of pinch bars operatively controlled by said actuating means and said transverse actuating member, said transverse actuating member and said pinch bars cooperatively arranged to selectively deform to a closed position and release said spouts upon operation of said actuating means.

13. The device according to claim 9 wherein said actuating means comprises a first actuator member and a second actuator member, said first and second actuator members operatively connected to said sealing means, said first and second actuator members being further adapted to be manually urged to said engaged position and said actuating means further comprising a spring operatively connected to one of said first or second actuator members and adapted to urge said actuating means to said null position.

14. The device according to claim 9 further comprising pressure release means interposed through said lid whereby gaseous pressure within said container is permitted to escape, said pressure release means being further adapted to seal itself if said contained liquid reaches a predetermined level.

15. The device according to claim 14 wherein said pressure release means comprises a poppet valve interposed through said lid and adapted to be urged into position by gravity or fluid pressure.

16. A method for selectively sealing a liquid filled vessel having an open top defined by a rim edge, comprising:

providing a lid specially configured to sealingly engage said rim of said vessel;

providing a plurality of deformable spouts through said lid whereby said provided spouts form passageways between said inside of said vessel and said outside of said lid;

providing sealing means for selectively opening and closing said apertures by deformation;

providing actuating means operatively connected to said sealing means for selectively positioning said sealing means such that said spouts are deformed closed or undeformed open, wherein said actuating means, in a null position, urges said sealing means to deform said spouts and, in an engaged position, urges said sealing means to undeform said spouts;

whereby said vessel may be selectively operated to permit the flow of liquid through said spouts or, alternatively, sealed.

17. The method according to claim 13 further comprising the step of providing pressure release means whereby gaseous pressure within said vessel may be vented through said lid, while said pressure release means is effectively sealed upon said contained liquid reaching a predetermined level.

* * * * *